US007802696B2

(12) United States Patent
Moore

(10) Patent No.: US 7,802,696 B2
(45) Date of Patent: Sep. 28, 2010

(54) SPENT GUM WRAPPER DISPENSER AND METHOD OF USING SAME

(76) Inventor: Dianne Mae Moore, 35 Abbey Rd., Elgin, SC (US) 29045

( * ) Notice: Subject to any disclaimer, the term of this patent is extended or adjusted under 35 U.S.C. 154(b) by 0 days.

(21) Appl. No.: 12/133,515

(22) Filed: Jun. 5, 2008

(65) Prior Publication Data

US 2008/0302696 A1 Dec. 11, 2008

Related U.S. Application Data

(60) Provisional application No. 60/941,981, filed on Jun. 5, 2007.

(51) Int. Cl.
*B65H 1/08* (2006.01)

(52) U.S. Cl. ..... 221/59; 221/56; 206/556; 206/499; 206/800; 206/804; 206/817

(58) Field of Classification Search ..... 206/800, 206/804, 817, 556, 39.4, 527, 499, 303; 221/59, 221/56

See application file for complete search history.

(56) References Cited

U.S. PATENT DOCUMENTS

| | | | | | |
|---|---|---|---|---|---|
| 381,266 | A * | 4/1888 | Miller | 312/45 |
| 417,166 | A * | 12/1889 | Geisenheimer | 206/39.4 |
| 1,072,859 | A * | 9/1913 | Kingsley | 221/59 |
| 1,671,285 | A * | 5/1928 | Hanna | 206/445 |
| 3,150,808 | A * | 9/1964 | Vensel | 225/106 |
| 3,675,912 | A * | 7/1972 | Des Jardins | 267/166 |
| 4,343,415 | A * | 8/1982 | Radek | 221/59 |
| 4,706,844 | A * | 11/1987 | Omdoll et al. | 221/59 |
| 4,913,312 | A * | 4/1990 | Boutin | 221/45 |
| 4,969,575 | A * | 11/1990 | Kobayashi | 221/45 |
| 5,088,620 | A * | 2/1992 | Kelliher et al. | 221/59 |
| 5,409,181 | A * | 4/1995 | Patrick | 242/596.2 |
| 5,935,730 | A * | 8/1999 | Will et al. | 429/167 |
| 6,830,152 | B2 | 12/2004 | Smith | |
| 7,380,666 | B1 * | 6/2008 | Buckelew | 206/527 |
| 7,380,688 | B2 * | 6/2008 | Fore | 221/235 |
| 2003/0080015 | A1 * | 5/2003 | Kopecky | 206/459.5 |
| 2004/0267109 | A1 * | 12/2004 | Dancel et al. | 600/407 |
| 2006/0273102 | A1 * | 12/2006 | Wieser et al. | 221/59 |

FOREIGN PATENT DOCUMENTS

WO 2005/100173 A1 10/2005

* cited by examiner

*Primary Examiner*—David T Fidei
(74) *Attorney, Agent, or Firm*—Calhoun Thomas, III; Samuel Alexander Long, Jr.

(57) ABSTRACT

The invention is a portable device designed to hold and dispense wafers used in the containment and disposal of spent chewing gum. The device is small and can be sized to fit in a person's pocket. The wafers are stacked, loaded, and housed in a chamber. When loading, the hinged lid is opened and a stack of wafers are inserted. An elevation spring and associated elevation pad propel the wafers in a position to be dispensed. The wafers are then dispensed by the user who pulls them through a lid opening. Once dispensed, the user wraps the wafer around the spent chewing gum and then disposes.

5 Claims, 6 Drawing Sheets

SPENT GUM WRAPPER DISPENSER AND METHOD OF USING SAME

RELATED APPLICATIONS

This application claims priority from U.S. Provisional Application 60/941,981 filed Jun. 5, 2007.

FEDERALLY SPONSORED RESEARCH OR DEVELOPMENT

Not applicable.

REFERENCED OR INCORPORATED MATERIAL

Not applicable.

FIELD OF INVENTION

The present invention relates to the fields of chewing gum and environmental awareness. More specifically, the invention is a portable device for conveniently carrying and dispensing gum disposal wrappers which allow the user to safely dispose of chewed gum.

SUMMARY OF THE INVENTION

The present invention is a device that facilitates the personal disposal of spent chewing gum. The invention contemplates a portable device that conveniently holds and dispenses small pieces of flat foldable material called wafers that can be used to encapsulate spent gum. The dispenser is small and portable. In one embodiment, the device is designed to compactly fit in a pocket or purse and may be attached to keys as part of a key chain. It may also be attached to walls or dashboards of cars with hook and loop fasteners or otherwise attached to surfaces through such means as magnets and clips. In another embodiment, the device is designed to sit on a table top, hold many wafers, and dispense the said wafers to diners at a table. The first embodiment is preferred for most situations and holds fewer wafers than the table top embodiment. However, the tabletop embodiment is preferred for restaurants, bars, and similar businesses.

The device of the present invention is designed to be loaded with small wafer pieces of material that are used to wrap spent pieces of chewing gum for disposal. The wafers are stacked one on another into the device for later use. A spring applies pressure to the stack of wafers and keeps the wafers presented to the top of the device where they may be easily removed for individual use.

The wafers are removed through a small opening in the lid of the device. The lid is designed so that the wafers may be removed with pressure applied by the user yet remain in place within the device during transport.

The end user is a person who has finished chewing a stick of gum and wishes to dispose of said gum. This end user pulls a wafer from the stack of wafers out of the opening in the top of the device. When the user so removes a wafer, the stack of wafers moves one wafer higher. The end user then places the spent gum in the recently pulled wafer, wraps the gum in the wafer by folding the excess material around the gum, and then properly disposes of the wrapped gum.

Typically, in the table top embodiment, the owner of the dining area, such as a restaurant owner, will place the device on a table top for his guests to utilize. In another embodiment, the user will carry the smaller device, loaded with less wafers, on his or her person and use it in locations that do not have a portable table top version.

DETAILED DESCRIPTION

Figure 1:
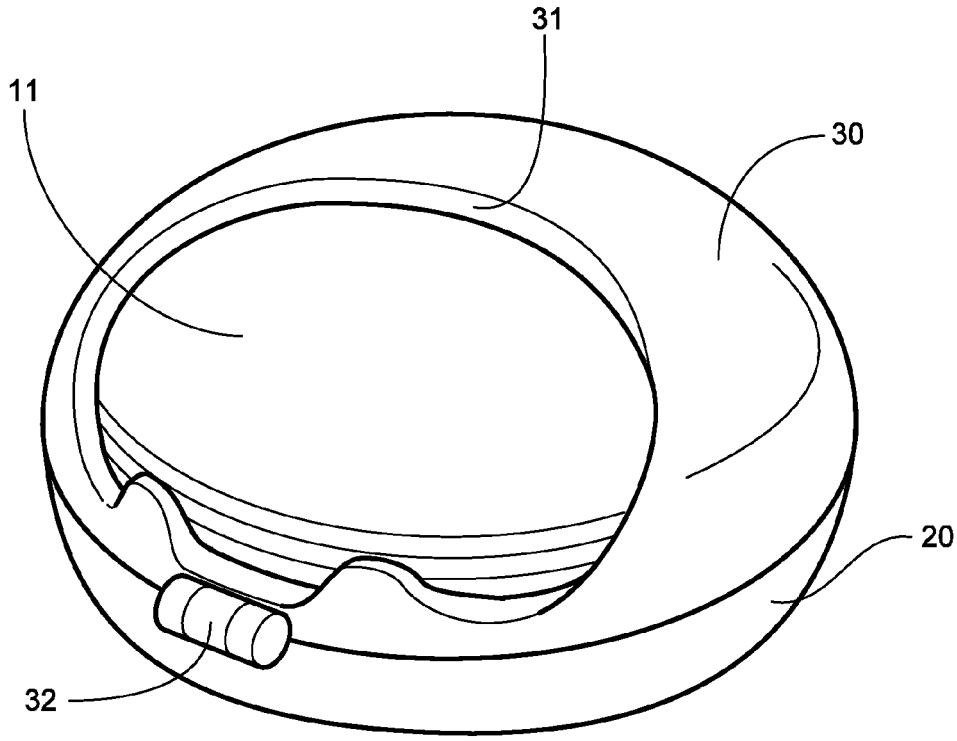
FIG. 1 is a perspective view of the compact personal embodiment.

It is to be understood by a person having ordinary skill in the art that the present discussion is a description of exemplary embodiments only and is not intended as limiting the broader aspects of the present invention. The following example is provided to further illustrate the invention and is not to be construed to unduly limit the scope of the invention.

The present invention is a portable device that dispenses gum wrappers in the form of wafers (11) for the disposal of spent chewing gum (10). The device comprises a chamber (20), a lid (30), a lid opening (31), an elevation spring (40), an elevation pad (41), and a plurality of wafers (11).

Figure 2:
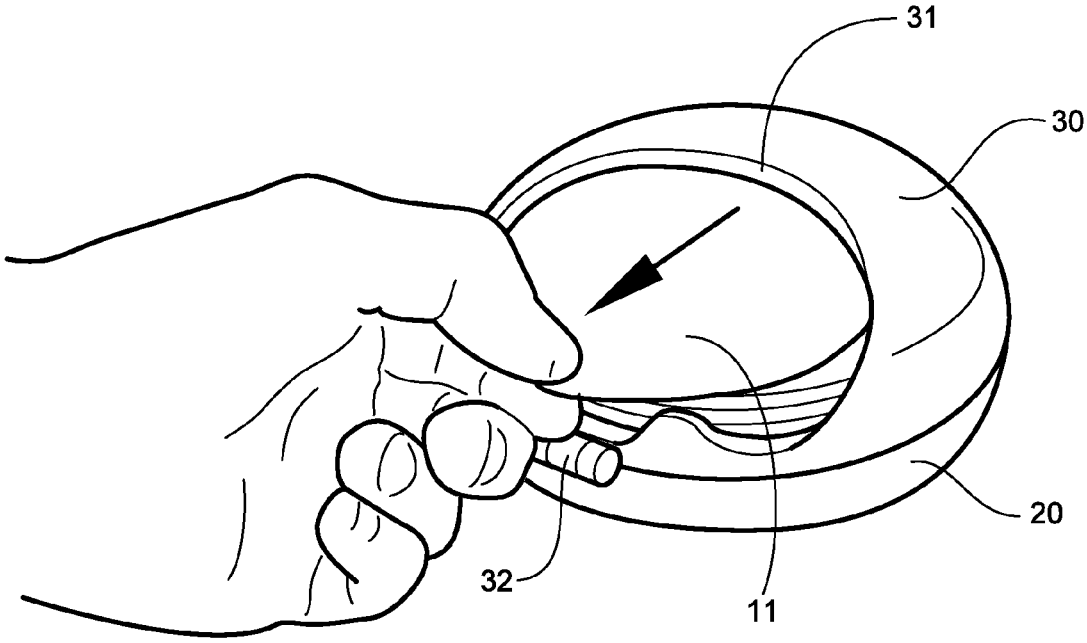
FIG. 2 is a perspective view of the compact personal embodiment highlighting the method by which wafers are removed from the portable device.
Figure 3:
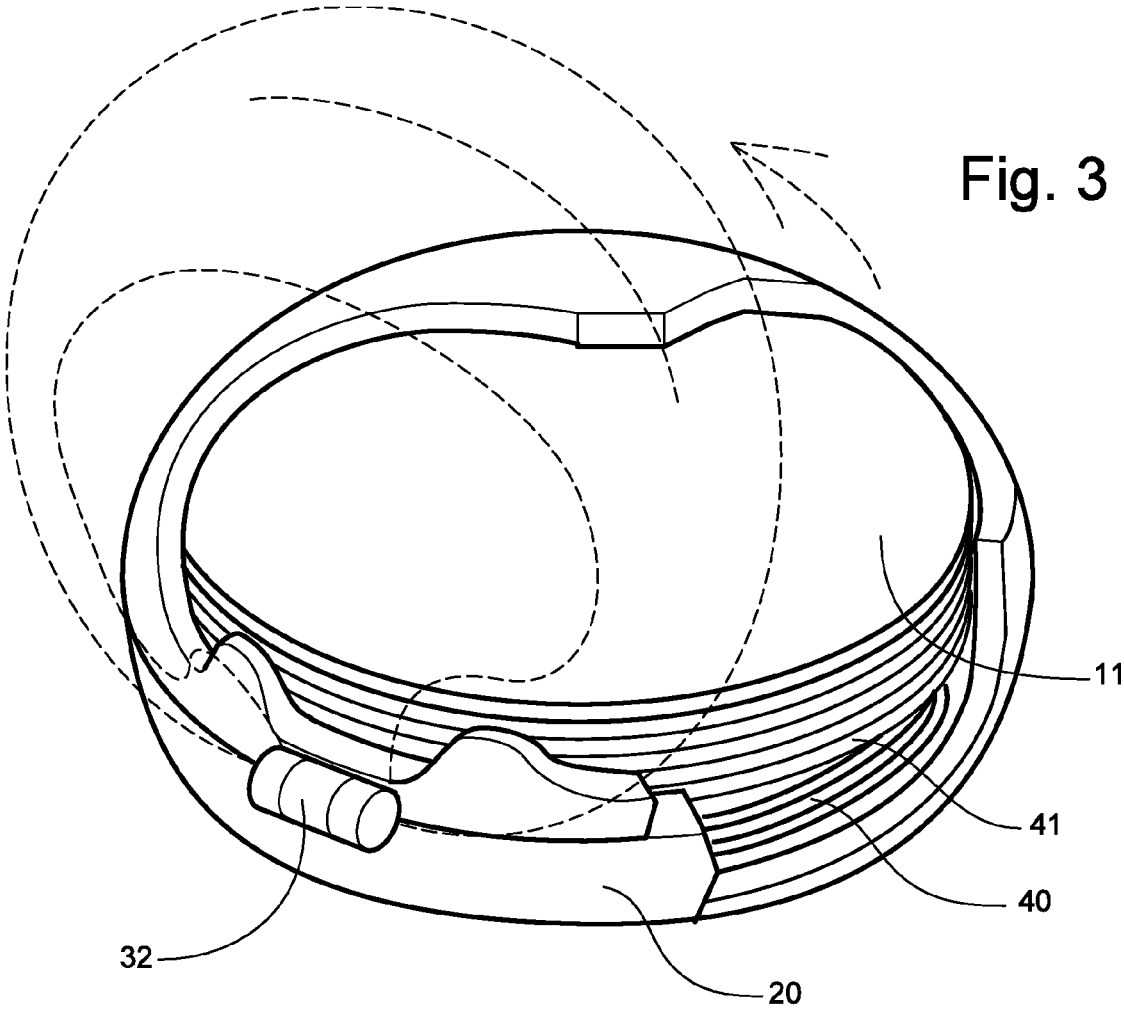
FIG. 3 is a perspective view of the compact personal embodiment highlighting the lid opening, the stacked wavers, and the elevation spring.

The chamber (20) is the portion of the device that houses the wafers (11). This chamber (20) can be small and house fewer wafers when portability is of concern (as shown in FIG. 1, FIG. 2, and FIG. 3) or larger (as shown in FIG. 5, FIG. 6, FIG. 7, and FIG. 8) and house many wafers (11) when multi person uses are of concern. In the preferred embodiment, the chamber (20) is made of lightweight plastic. A cross section of the chamber (20) is circular in shape. In the table top embodiment (FIG. 5, FIG. 6, FIG. 7, and FIG. 8), the overall shape of the chamber (20) is generally cylindrical whereas in the personal embodiment (FIG. 1, FIG. 2, and FIG. 3), the chamber (20) is saucer shaped.

Attached to the chamber (20) is a lid (30). In the compact personal embodiment, the lid (20) is hingedly (32) attached to the chamber (20). The hinge (32) operates from a closed position to an open position (as highlighted in FIG. 3) in the manner of a clam shell. In the open position, the chamber (20) may be filled and refilled with wafers (11). In the closed position, wafers (11) are removed for use through an opening in the lid (30). Fixedly attached to the lid (30) on a side opposite the hinge (32) is a clasp for securing the lid (30) in the closed position. The clasp, also made of plastic, flexes over a fixed ridge on the chamber to secure the lid and prevent opening from ordinary jolts to the device.

In the preferred embodiment of the table top embodiment, the lid (30) is likewise hingedly attached to the chamber (20). Like the personal version, the lid operates from a closed position to an open position. In the open position, the chamber (20) may be filled and refilled with wafers (11). In the closed position, wafers (11) are removed for use through an opening (31) in the lid (30). Fixedly attached to the lid (30) on a side opposite the hinge (32) is a standard clasp for securing the lid (30) in the closed position. The clasp, also made of plastic, flexes over a fixed ridge on the chamber (20) to secure the lid (30) and prevent opening from ordinary jolts to the device.

In alternate embodiments of the table top version, the lid (30) will attach to the chamber (20) via a threaded connection where inwardly articulated threads disposed on the lid mesh with outwardly articulated threads disposed on the upper portion of the chamber. In place of a threaded attachment, many other types of removable means of attachment may be implemented such as a friction connection.

In still a further embodiment, instead of the lid (30) being hingedly or removably attached, the lid (30) is fixedly attached such that when the last wafer (11) is used, the device is discarded rather than being refilled.

Also attached to the chamber (20) is an elevation spring (40). The elevation spring (40) is designed to keep the wafers (11) near the top of the chamber (20) at the lid (30) so that the user may easily remove the wafers (11) for use. The means for supplying the spring force for the elevation spring (40) can utilize many different elastic means as long as the wafers (11) are kept to the top without extreme pressure. In the preferred embodiment, the spring force is supplied by means of a coil spring.

Attached to the elevation spring (40) is an elevation pad (41). The wafers (11) rest on the elevation pad (41). The elevation pad (41) has a diameter slightly smaller than that of the chamber (20). In the preferred embodiment, the elevation pad (41) is made of plastic but many materials could be acceptable.

The wafers (11) are small pieces of foldable material that cling to the spent gum (10). Typically, the wafers (11) are made of metal foil, such as aluminum. However, many other materials may be used such as paper or plastic. The wafers (11) have a diameter similar to the elevation pad (41) such that they are smaller in diameter than the diameter of the chamber (20).

Figure 4:
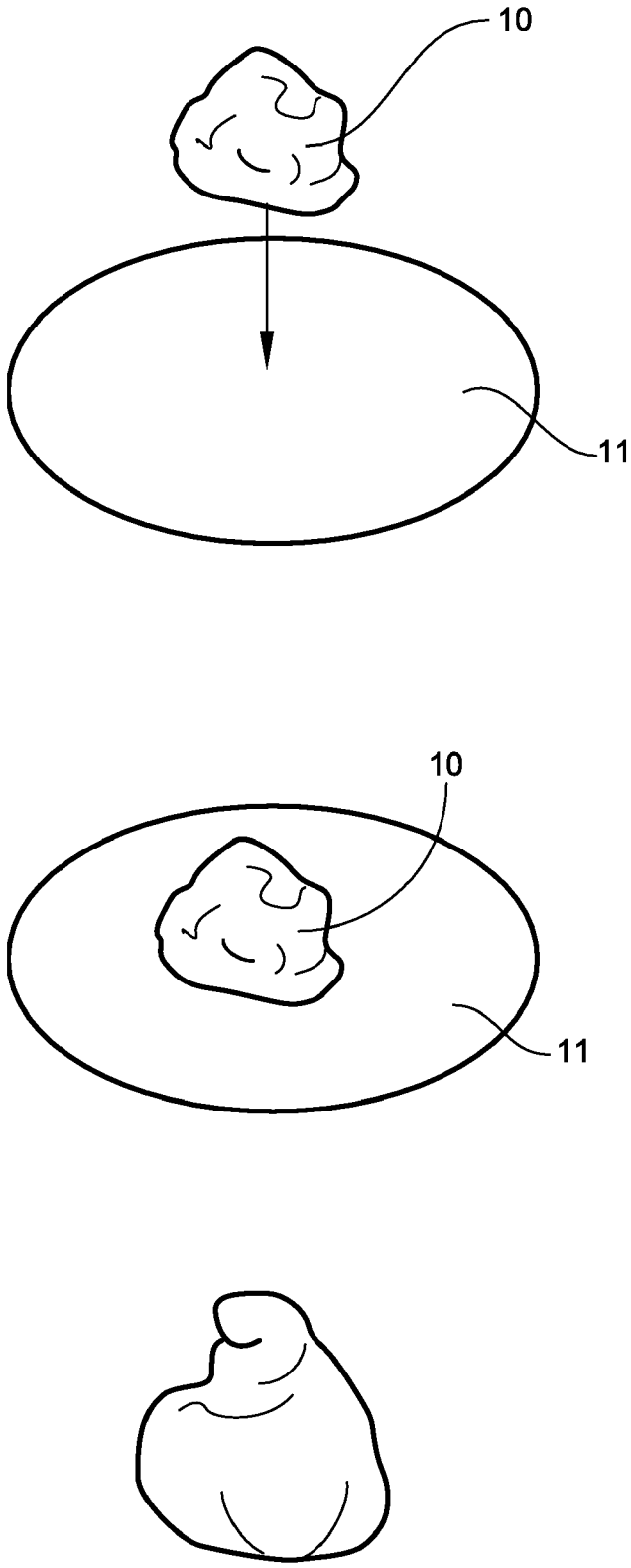
FIG. 4 is a process view demonstrating how the spent chewing gum is wrapped in a wafer.
Figure 5:
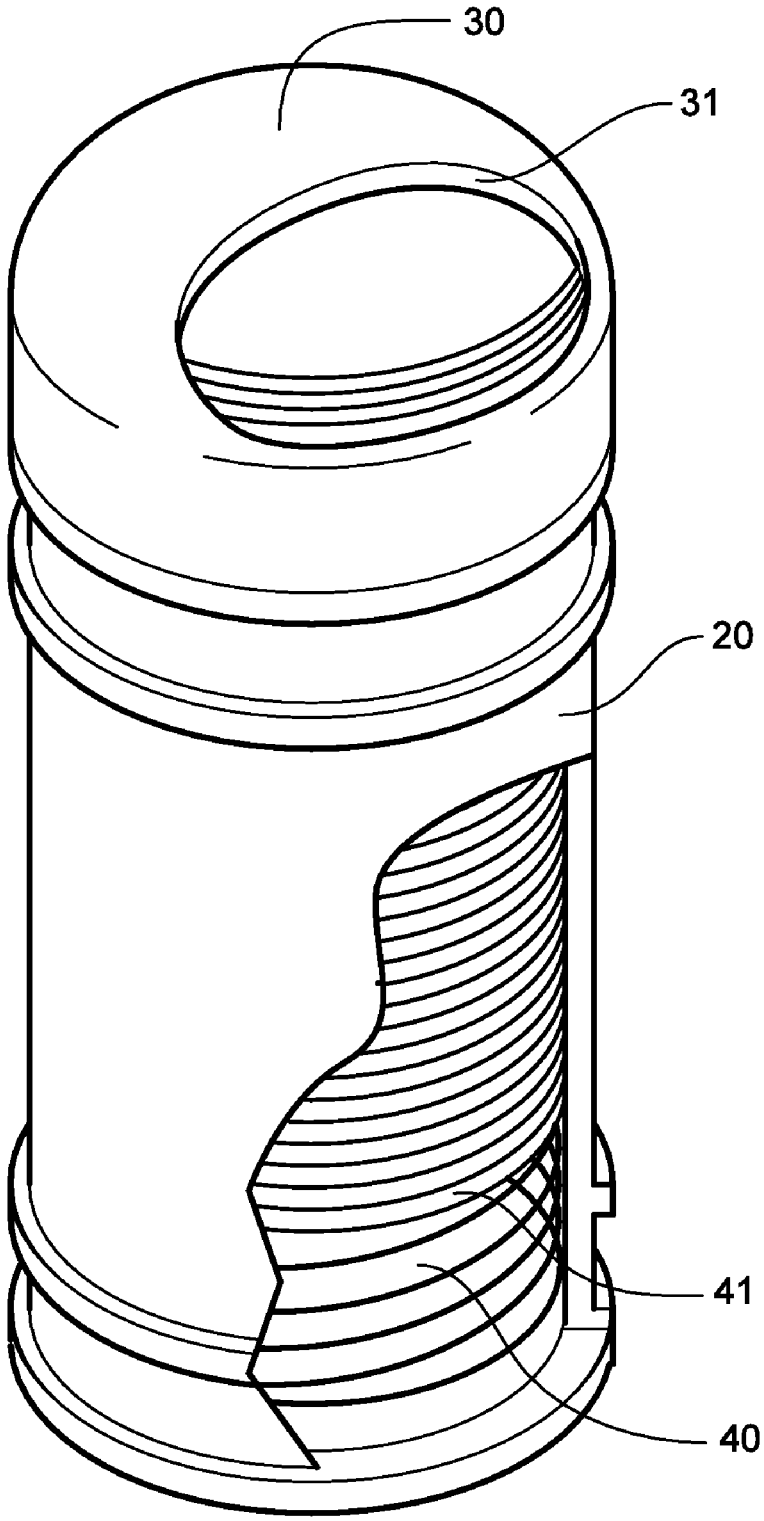
FIG. 5 is a perspective view of the table top embodiment highlighting the elevation spring and the loaded wafers inside the chamber.
Figure 6:
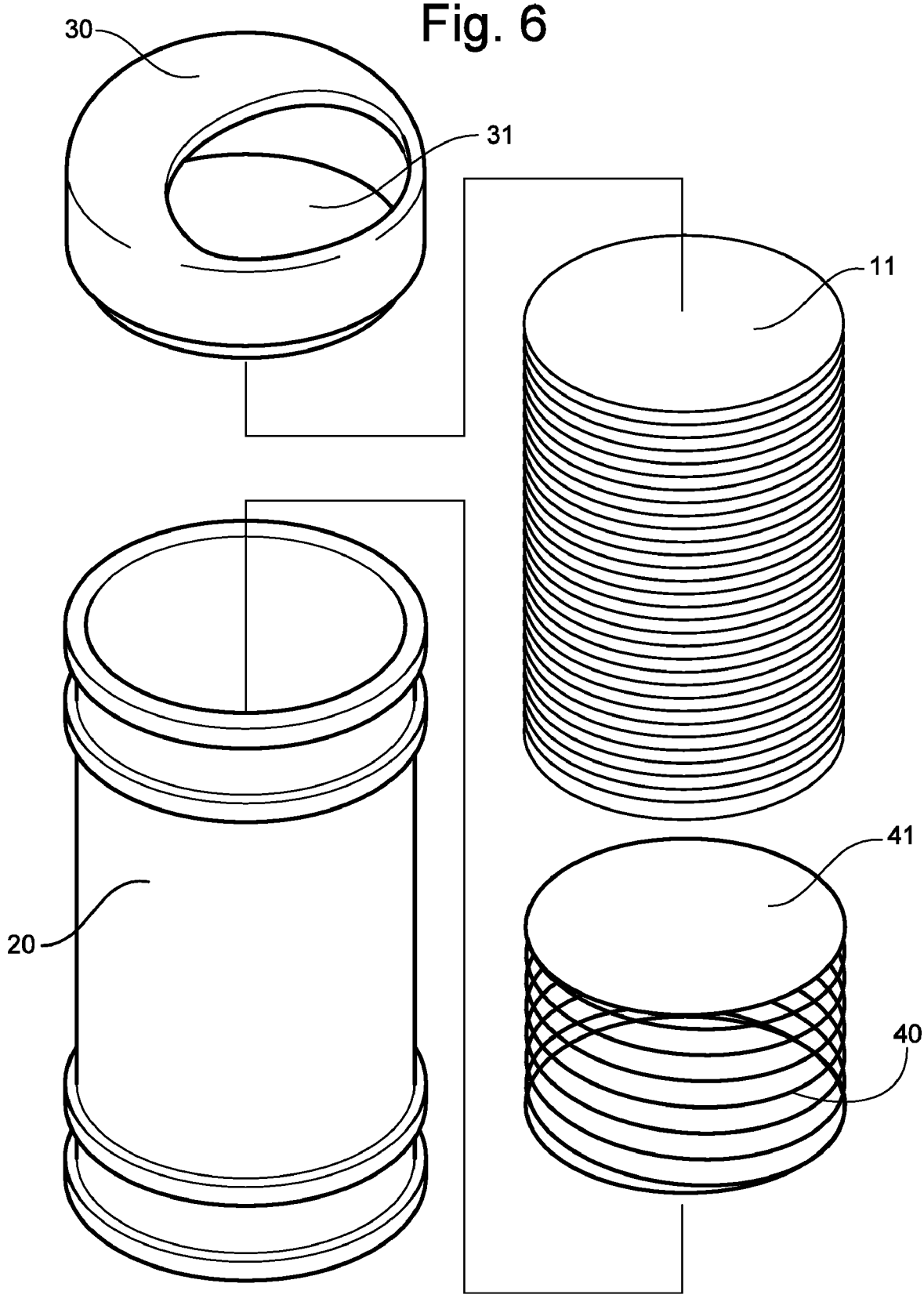
FIG. 6 is an exploded view of the table top embodiment.
Figure 7:
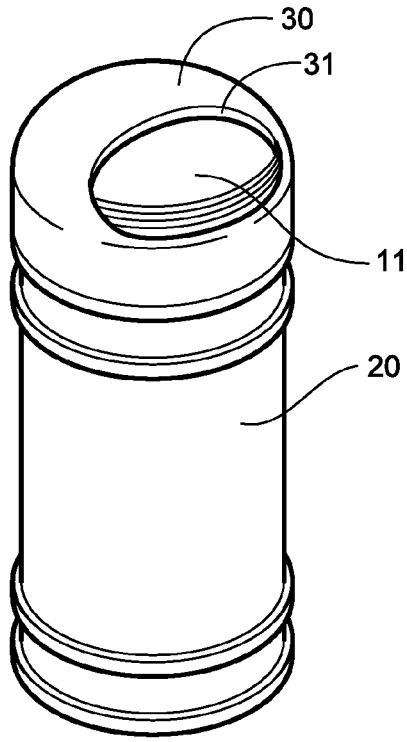
FIG. 7 is a perspective view of the table top embodiment.
Figure 8:
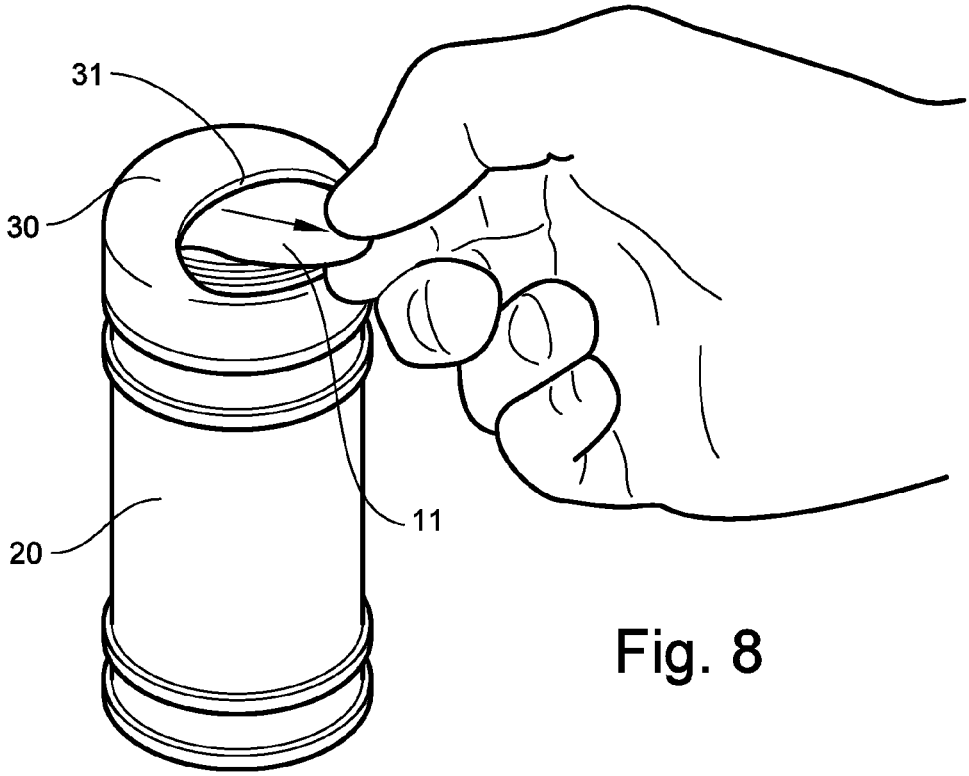
FIG. 8 is a perspective view of the table top embodiment highlighting the method by which wafers are removed from the portable device.

The wafers (11) are dispensed from the device by the user via a lid opening (31) when the lid (30) is in the closed position (as highlighted in FIG. 2 and FIG. 8). The lid opening (31) is a slot disposed in the lid (30) that is large enough for a human finger to manipulate a wafer (11) from the device yet still retain the wafers (11) from undesired movement out of the device. In the preferred embodiment, the elevation pad (41) presses the stack of wafers (11) against the top of the lid (30) while a portion of the wafer (11) remains exposed via this lid opening (31). In this way, the user presses a finger against the exposed wafer (11) and pulls the wafer (11) through the lid opening (31). He then wraps and folds the wafer around the spent chewing gum (as shown in FIG. 4) and disposes of the used article in an environmentally conscience way.

What is claimed is:

1. A spent gum wrapper dispenser comprising:

a plurality of wafers, said wafers being made of thin metal foil and having a circular shape;

a chamber for containing the wafers, said chamber being cylindrical in shape with a diameter size slightly larger than one of said wafers, made of plastic, and further comprising an interior surface, an exterior surface, and a bottom also having an interior surface and an exterior surface;

a lid, made of plastic, hingedly attached to the chamber, having a convex saucer-shape, operating from an open position to a closed position, and having an interior and an exterior surface;

a lid opening, disposed on said lid, having an elliptical shape, and being sized to allow a human finger to touch and remove one of said plurality of wafers through the lid opening;

an elevation spring, having a top end and a bottom end, said bottom end being attached to the interior surface of the bottom of the chamber, supplying a spring force in a direction upward, with respect to the interior surface of the chamber, toward the lid;

an elevation pad, fixedly attached to the top end of said elevation spring and having a circular shape with approximately the same diameter as the plurality of wafers; and a securing means for securing said lid to said chamber.

2. The spent gum wrapper dispenser of claim 1 wherein said bottom has a convex saucer-shape such that, together, the bottom and lid function in the manner of a clam shell when operating from said open position to said closed position.

3. The spent gum wrapper dispenser of claim 1 wherein said bottom is flat.

4. The spent gum wrapper dispenser of claim 2 wherein said securing means is a clasp means comprising a flexible plastic clasp disposed on the lid and a fixed plastic ridge disposed on the exterior surface of said chamber, said plastic clasp flexing over said fixed plastic ridge to secure the lid in the closed position.

5. The spent gum wrapper dispenser of claim 4 wherein the chamber has a cylinder height less than 2 inches such that it may easily fit into a typical person's pocket.

* * * * *